United States Patent [19]

Urbani

[11] Patent Number: 4,776,112

[45] Date of Patent: Oct. 11, 1988

[54] SLUDGE POND VEHICLE

[75] Inventor: William G. Urbani, Stockton, Calif.

[73] Assignee: Industrial Innovations, Stockton, Calif.

[21] Appl. No.: 868,812

[22] Filed: May 29, 1986

[51] Int. Cl.[4] ..... E02F 3/88

[52] U.S. Cl. ..... 37/58; 37/71; 210/242.1

[58] Field of Search ..... 37/54, 57, 58, 71; 210/241, 242.1, 242.3, 170; 414/373; 440/48, 98

[56] References Cited

U.S. PATENT DOCUMENTS

| | | | |
|---|---|---|---|
| 3,064,370 | 11/1962 | La Fleur | 37/71 |
| 3,238,549 | 3/1966 | Burlin et al. . | |
| 3,412,862 | 11/1968 | Chaplin | 210/241 X |
| 3,416,176 | 12/1968 | Ravitts . | |
| 3,796,658 | 3/1974 | Meissner, Sr. . | |
| 3,876,540 | 4/1975 | Falxa . | |
| 4,032,449 | 6/1977 | De Visser et al. . | |
| 4,092,790 | 6/1978 | Sonerud | 37/71 |
| 4,152,800 | 5/1979 | Nilsmar . | |
| 4,154,678 | 5/1979 | Kole . | |
| 4,232,903 | 11/1980 | Welling et al. | 37/54 X |
| 4,412,394 | 11/1983 | Coker | 37/62 X |
| 4,642,919 | 2/1987 | Werner et al. | 37/71 X |

FOREIGN PATENT DOCUMENTS

| | | | |
|---|---|---|---|
| 2411115 | 9/1974 | Fed. Rep. of Germany | 37/71 |

*Primary Examiner*—Kenneth J. Dorner
*Assistant Examiner*—Peter R. Brown
*Attorney, Agent, or Firm*—Townsend and Townsend

[57] ABSTRACT

A sludge pond vehicle, for use with an onshore waste processor, includes a frame to which a pair of elongate, generally cylindrical pontoons and a trash pump are mounted. Each pontoon has a spiral flight about its outer surface and each is individually driven about its own axis so to propel the vehicle through a sludge pond. The frame includes pivotal support arms at each end between which the elongate pontoons are mounted. Pivoting the support arms relative to one another causes the pontoons to separate and approach each other thus raising and lowering the trash pump. High pressure hot water is sprayed into the sludge pond in the region of the trash pump to aid removal of the sludge. The various power and control lines are carried by an overhead boom pivotally mounted to the frame. The boom can pivot freely over an arc of about 270° to permit relatively unrestricted movement of the sludge pond vehicle.

13 Claims, 5 Drawing Sheets

SLUDGE POND VEHICLE

BACKGROUND OF THE INVENTION

This invention relates to cleaning systems and apparatus, in particular a vehicle used for pumping waste from a pond, pit or other area.

In many industrial settings certain areas have been used to dump various solid and liquid wastes. These areas are often ponds or pits and contain a mixture of water, nonaqueous liquids, suspended solids, flowable wastes and solid trash such as bottles, old tires and used drums.

It has become painfully evident that such waste sites can create a severe environmental problem due to leaching of substances into the earth. Even if leaching is not a problem, such sites can create serious problems if simply filled in with soil once the site is no longer needed. Accordingly, there has been an increased interest in cleaning these sites, collectively called sludge ponds in this application. However, because of the physical makeup of sludge ponds, substantial obstacles hinder cleanup. There are problems associated with the process of physically removing and separating the water, muck, trash and other material, collectively termed sludge, found in the sludge pond. The wide variety of toxic and noxious materials often dumped into or which leak into sludge ponds creates substantial health risks to those removing the sludge.

SUMMARY OF THE INVENTION

The present invention is directed to a sludge pond vehicle which solves many of the problems associated with draining sludge ponds. In particular, the vehicle is remotely controlled to physically remove the operator from the actual sludge pond for increased safety. The vehicle is adapted to move through conditions ranging from liquid, such as water and oil, to only flowable, such as muck and relatively viscous petroleum products.

The sludge pond vehicle, used with an on-shore waste processing system, includes a frame to which a pair of elongate, generally cylindrical pontoons and a trash pump are mounted. The pontoons have spiral flights about their outer surfaces. Each portion is individually driven about its own axis so to propel the vehicle through the sludge pond. The pontoons and trash pump are mounted to the frame in a manner so their relative elevations can be changed. This permits the trash pump to be positioned at or below the sludge pond surface when sludge is being removed, or above the surface when the vehicle is simply moving across the sludge pond.

The frame, in the preferred embodiment, includes an elongate center section and support arms pivotally mounted at each end of the elongate center section. The pontoons are rotatably mounted to the pivotal support arms. The support arms at each end are coupled to one another through hydraulic rams. Actuating the rams causes the support arms to pivot relative to one another to separate the pontoons, thus lowering the trash pump, or to retract (approach one another), thus raising the trash pump.

The sludge pond vehicle is adapted to move over the surface a sludge pond or, by adding water to the pontoons to reduce their buoyancy, along the bottom of the sludge pond. By changing the angular orientation of the upport arms the relative height of the pontoons and pump can be accurately varied according to what, if anything, is to be pumped out. Thus, when no pumping is being done the vehicle can move about a sludge pond with the trash pump and associated support structures above the surface of the sludge pond. This drastically reduces the drag. Also, the trash pump can be adjusted to just skim the surface or to be completely submerged according to conditions at hand.

High pressure hot water, or other suitable cleaning liquid, can be provided to the vehicle and sprayed into the sludge pond in the region of the trash pump. This aids removal of the sludge by liquifying it through the addition of water and through the raising of the temperature of the sludge. Hot water can also be injected into the sludge line extending from the trash pump to the on-shore waste processor to aid passage of the sludge along the sludge line. In the preferred embodiment, the various drive elements driven by hydraulic fluid are controlled through the use of air pilot valves. The various air control lines, the hot water line, the hydraulic lines and the sludge return line are preferably carried by an overhead boom pivotally mounted to the frame. The boom can pivot freely over an arc of, for example, about 270° to permit relatively unrestricted movement of the sludge pond vehicle.

All controls to the sludge pond vehicle are preferably either pneumatic or hydraulic thus eliminating the safety and reliability problems associated with electric controls. This is important since the contents of the sludge pond may be unknown.

The flights on the pontoons are wrapped in opposite rotary directions so that rotating the two pontoons in opposite directions at the same speed propels the vehicle in a straight line. The vehicle can be turned by changing the relative rotary speeds of the pontoons. By rotating the pontoons in the same rotary direction at the same speed the vehicle can turn about its own vertical axis.

Other features and advantages of the invention will appear from the following description in which the preferred embodiment has been set forth in detail in conjunction with the accompanying drawings.

DETAILED DESCRIPTION OF THE PREFERRED EMBODIMENT

Figure 1:
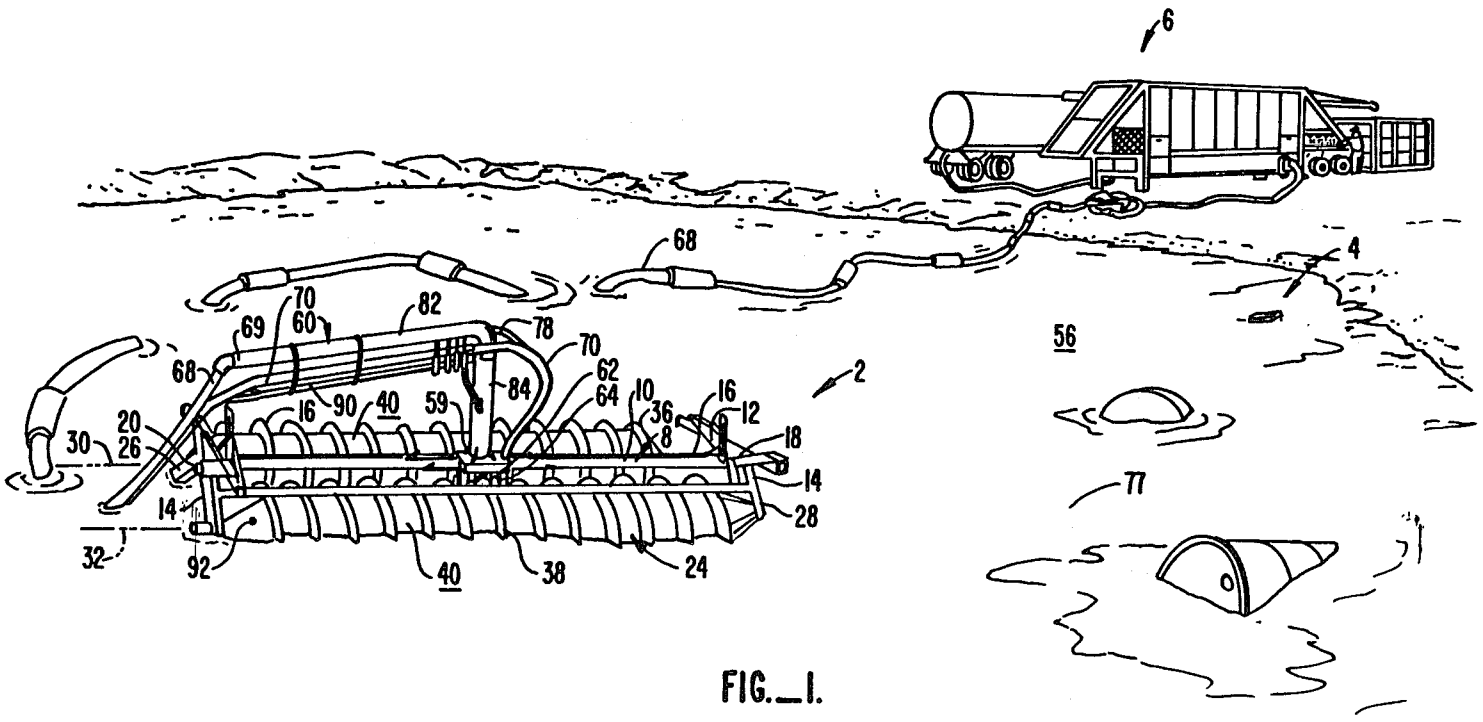
FIG. 1 is an overall view showing the sludge pond vehicle in use in a sludge pond in conjunction with an on-shore waste processor.

Referring now to FIG. 1, a sludge pond vehicle 2 is shown in use on a sludge pond 4 and connected to an on-shore waste or sludge processor 6. Processor 6 can include apparatus similar to that disclosed in U.S. Pat.

No. 4,466,154 entitled "Tank Cleaning System," the disclosure of which is incorporated by reference. Processor 6 can be a single, self-contained unit or a number of separate units. Processor 6 makes up no part of this invention and will not be described further.

Sludge pond vehicle 2 is particularly adapted for cleaning sludge ponds containing readily flowable liquid, such as water and oil, solid material such as bottles, rags and other debris, and thick but flowable material often in the form of muck at the bottom of the pond or pit. These various components will be collectively termed sludge and the area from which the sludge is taken will be called a sludge pond. However, it should be understood that sludge and sludge pond are broader in scope and include a wide variety of materials such as simply dirty water or viscous hydrocarbons which can be found in earthen pits, concrete lined ponds, etc.

Figure 2:
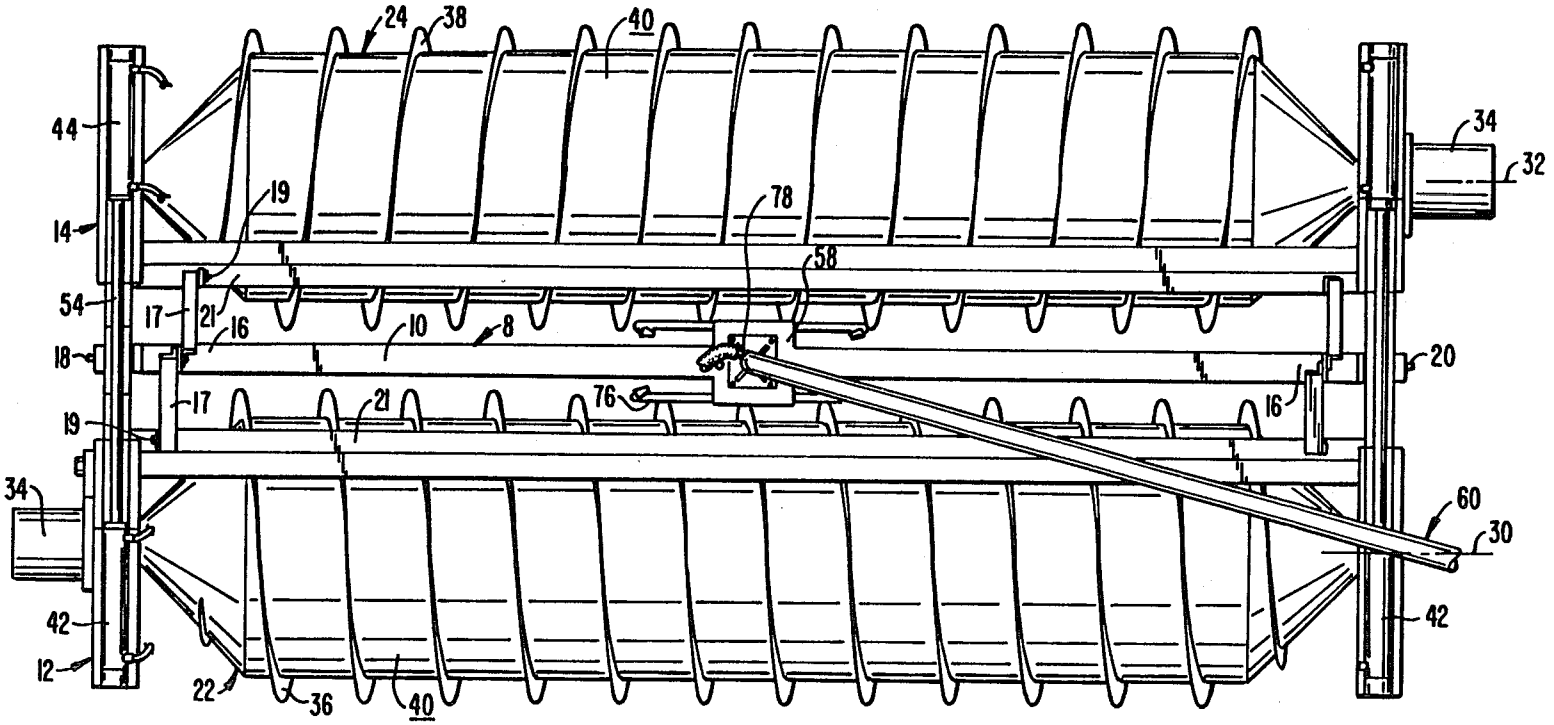
FIG. 2 is a top view of the vehicle of FIG. 1.
Figure 5:
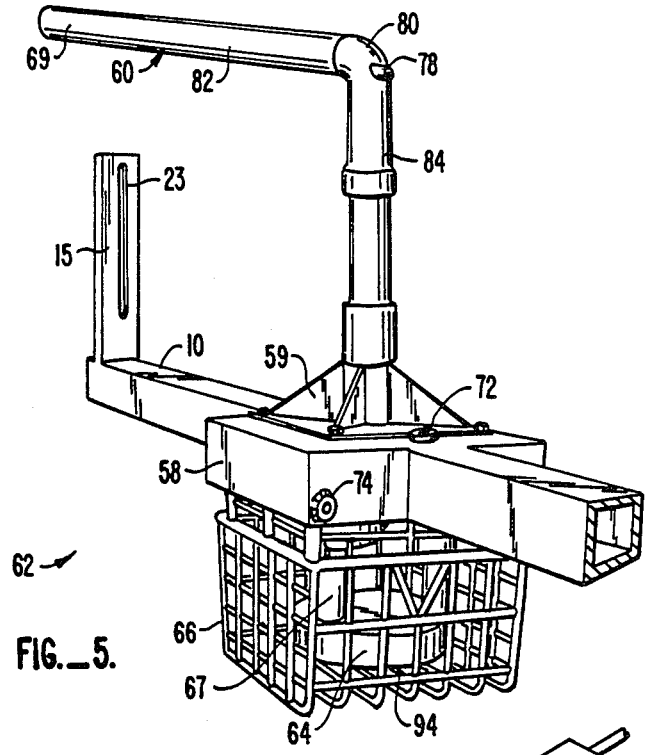
FIG. 5 is a perspective view of the elongate center section of the frame to which a boom, pump, motor and cage are mounted at its center and an upright at the ends.
Figure 4:
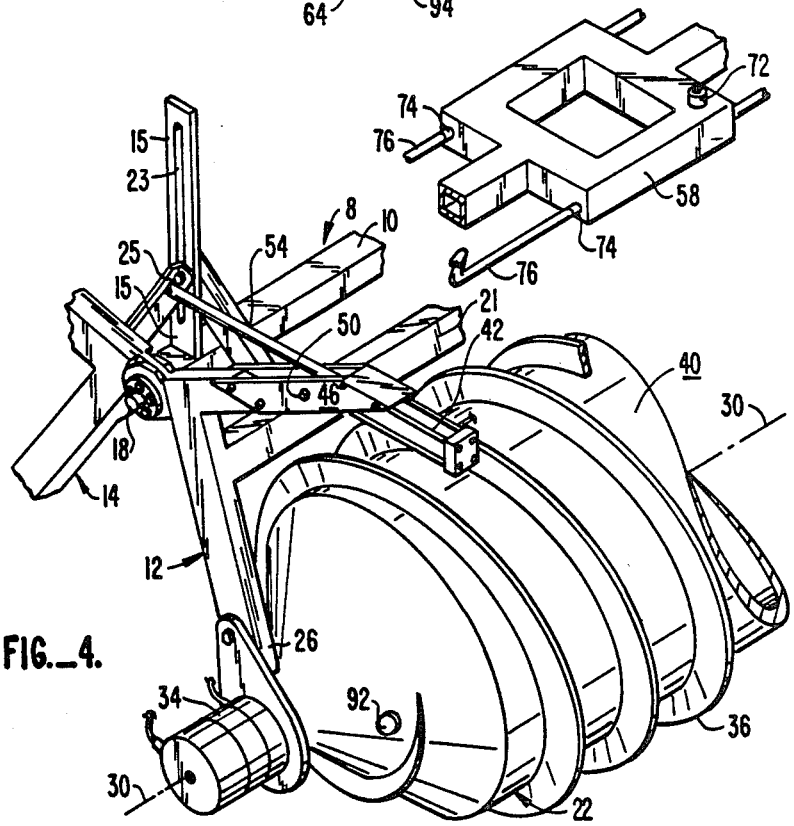
FIG. 4 is an isometric view illustrating a portion of the frame and part of one pontoon.

Referring also to FIGS. 2, 4, and 5, vehicle 2 is seen to include a frame 8 having an elongate center section 10, pairs of generally L-shaped support arms 12, 14 pivotally secured to frame 8 at each end 16 of center section 10 at pivot points 18, 20, and elongate support arm braces 21, one extending between support arms 12 and one between support arms 14. An upright 15 is mounted to and extends upwardly from each end of center section 10. Guide braces 17 are pivotally secured to each brace 21 at pivot points 19 at their one ends and to upright 15 at their other ends with a bolt 25 (FIG. 4) passing through a slot 23 in upright 15. Pivotal movement of arms 12, 14 can be restrained by tightening bolts 25 at each end of vehicle 2.

A pair of generally cylindrical pontoons 22, 24 are mounted to the lower ends 26, 28 of support arms 12, 14 for rotation about their respective axes 30, 32. A hydraulic drive motor 34 is mounted at one end of each pontoon 22, 24 (see FIG. 2) so to rotate the pontoons about their respective axes 30, 32. Spiral flights 36, 38 are wrapped about the outer surfaces 40 of pontoons 22, 24 in opposite rotary directions so that rotation of the pontoons by hydraulic motors 34 in opposite rotary directions at the same speed causes vehicle 2 move across sludge pond 4 in a generally straight line. Turning of vehicle 2 is achieved by varying the rotary speeds or the rotary directions, or both, of pontoons 22, 24. The flighted pontoons 22, 24 both support and drive vehicle 2 over even the most difficult of sludge pond environments.

Figure 3A:
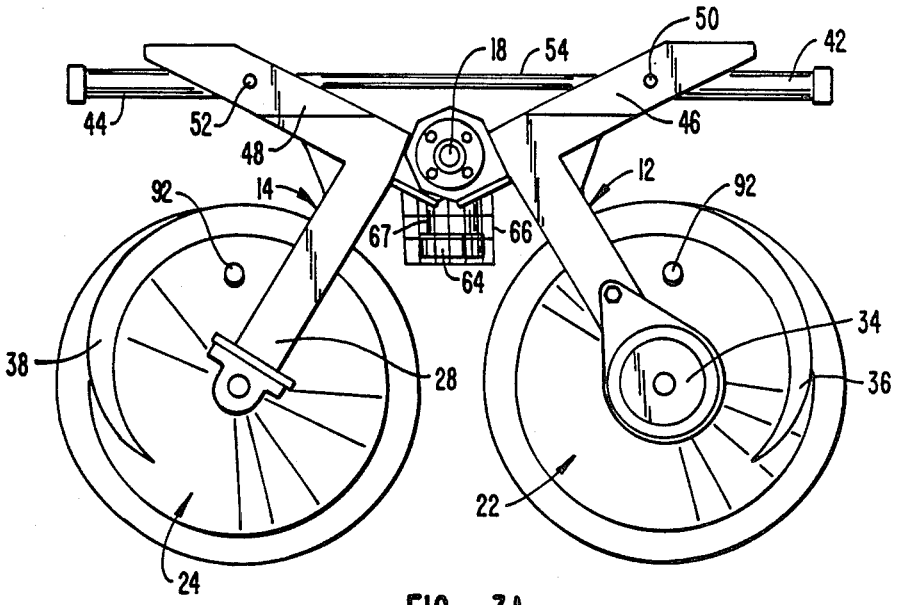
FIGS. 3A and 3B are end views of a portion of the vehicle of FIG. 1 with the trash pump in raised and lowered position, respectively.
Figure 3B:
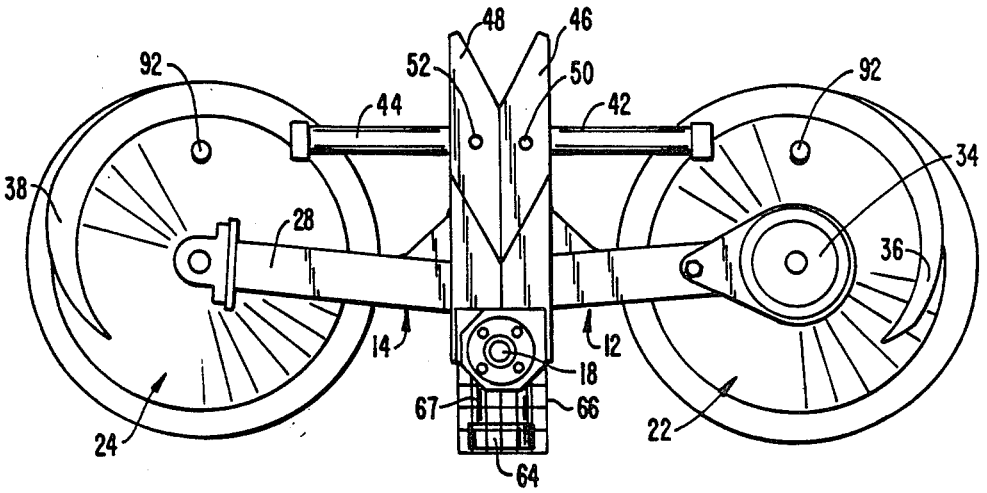

Referring also to FIGS. 3A and 3B, the relative angular orientation of support arms 12, 14, and thus the elevation of elongate center section 10 of frame 8 relative to sludge pond 4, is varied during use by the use of hydraulic rams 42, 44 pivotally secured along their lengths to the upper ends 46, 48 of support arms 12, 14 at pivot points 50, 52. Rams 42, 44 have a common piston rod 54 so that appropriate actuation of the rams causes upper ends 46, 48 to approach and separate thus causing pontoons 22, 24 to separate and approach. This movement changes the relative height or elevation between elongate center section 10 and pontoons 22, 24 thus changing the elevation of the center section relative to the surface 56 of sludge pond 4.

The central portion of center section 10 includes a rectangular manifold 58 (see FIGS. 4 and 5) serving several functions. Manifold 58 acts as the center structural portion of elongate center section 10 and also acts to support a boom mount 59 to which an overhead boom 60 is pivotally secured. A hydraulic pump motor 62 (see FIG. 6) is secured beneath manifold 58 and drives a trash pump 64 mounted to and beneath motor 62. Therefore, actuation of rams 42, 44 changes the relative elevation or height of pontoons 22, 24 and trash pump 64. This permits trash pump 64 to be positioned above surface 56 of sludge pond 4, FIG. 3A, submerged within sludge pond 4, FIG. 3B, or anywhere in between.

Trash pump 64 is enclosed within a metal cage 66 to protect pump motor 62 and trash pump 64 while allowing sludge within sludge pond 4 to enter the trash pump.

L-shaped boom 60 serves as a conduit through which sludge 77 is pumped by trash pump 64 to sludge processor 6. Sludge 77 passes from pump 64 through a conduit 67 to the lower end of boom 60 housed within boom mount 59. Sludge 77 then passes through the interior of L-shaped boom 60 and through a flexible sludge return line 68 (FIG. 1) extending between the outer end 69 of boom 60 and sludge processor 6. Hydraulic lines, a high pressure hot water line and pneumatic control lines, discussed below, extend from processor 6 and vehicle 2 and are secured to return line 68 and along boom 60.

Figure 6:
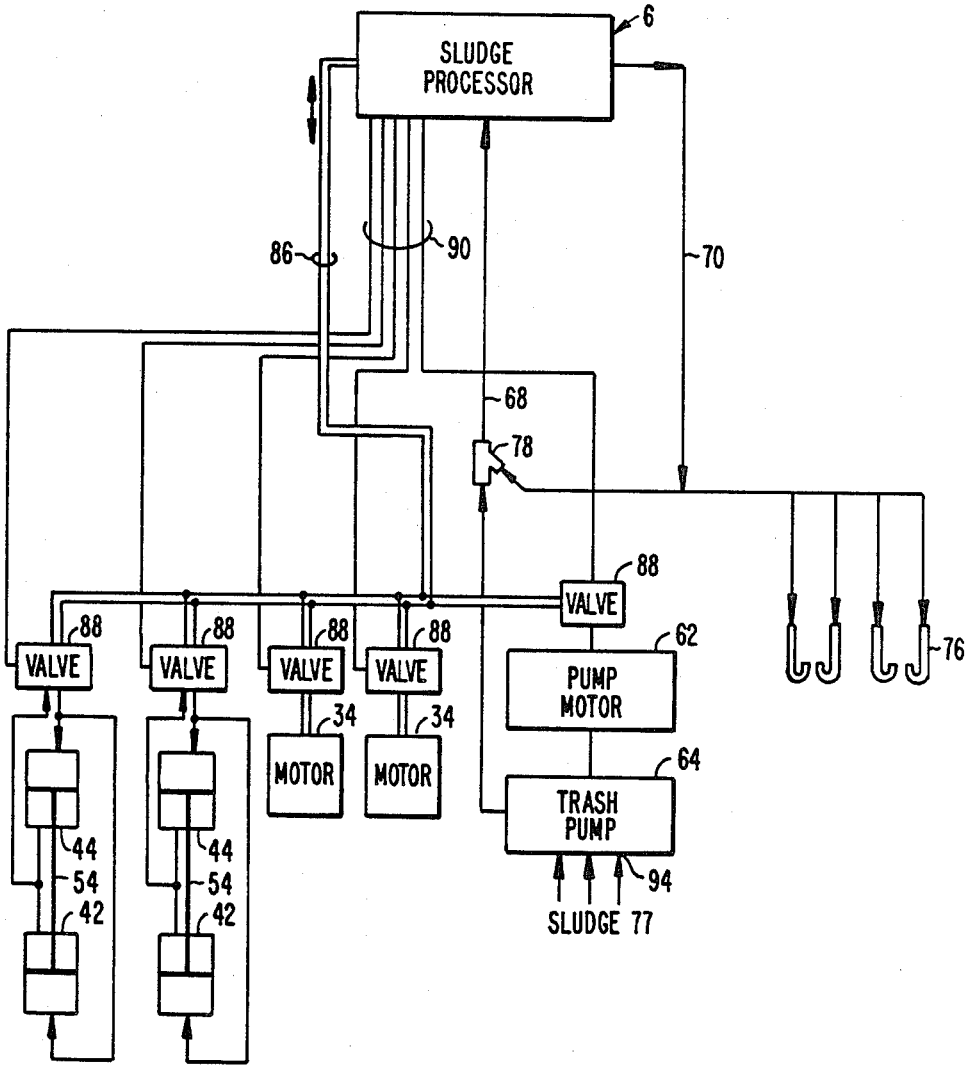
FIG. 6 is a schematic diagram showing the operational components of the vehicle of FIG. 1 and their connections to the on-shore waste processor.

The high pressure hot water line 70 extends, as shown in FIGS. 1 and 6, from processor 6, along line 68, along boom 60 and to an inlet 72 (see FIG. 5) of manifold 58. Manifold 58 has four outlets 74 through which the hot water flows. A J-shaped sprayer 76 is mounted to each outlet 74 so that high pressure hot water can be sprayed back towards trash pump 64 and into sludge 77 in sludge pond 4. This aids removal of sludge 77 by enhancing the liquification of sludge 77 by virtue of the added liquid. The heat provided by the high pressure hot water also helps to liquify, and thus make more flowable, many materials found in sludge pond 4. Liquids other than hot water, with or without cleaners added, can be used as well.

Turning now to FIG. 6, a schematic diagram illustrating the operation and control of vehicle 2 is shown. Sludge processor 6 receives sludge from vehicle 2 through line 68. Hot water is delivered from sludge processor 6 through hot water line 70 to manifold 58 and then to J-shaped sprayers 76. Hot water is also introduced into interior of boom 60 by a hot water injector 78 at the intersection 80 of the horizontal and vertical components 82, 84 of the boom. See FIG. 5. Rams 42, 44, drive motors 34 and trash pump motor 62 are all connected to two-way hydraulic power lines 86. Hydraulic fluid is supplied to these various devices through the use of air pilot valves 88 mounted to boom 60 at 89 (FIG. 1). Individual pneumatic control lines 90 extend between sludge processor 6 and the air pilot valve 88 associated with the hydraulically driven components so that such components can be separately controlled through its air pilot valve 88. This reduces the number of pairs of hydraulic lines which must be used between processor 6 and vehicle 2 to two. Only a single pneumatic control line 90 is needed for each hydraulically driven device so the total number of lines is reduced. Also, since the pneumatic control lines are subjected to much less pressure than the hydraulic power lines, the size, weight and cost of the lines are reduced as well.

In use, sludge pond vehicle 2 is brought to a sludge pond 4 intended to be drained or have contaminants removed. With the various pneumatic control lines 90, hydraulic power line 86, sludge return line 68 and high pressure hot water line 70 connecting sludge processor 6 on shore and vehicle 2 in the sludge pond, the pontoon drive motors 34 are actuated to rotate their associated pontoons 22, 24 to move vehicle 2 in the required direction. Once in position to begin operation, rams 42, 44 are actuated through their appropriate pneumatic control lines 90 to separate pontoons 22, 24 thus lowering trash pump 64 into sludge pond 4. Pump motor 62 is then actuated to pump sludge from sludge pond 4 through conduit 67, boom 60 and line 68 to processor 6. If necessary or desired, high pressure hot water, or other supplemental liquid, can be supplied to vehicle 2 through line 70 to be sprayed through sprayers 76 and injected by injector 78 into the sludge moving along boom 60. When it is desired to move along sludge pond 4 without the drag caused by pulling cage 66, trash pump 64 and pump motor 62 through the sludge pond, rams 42, 44 are actuated to cause pontoons 22 24 to approach one another (FIG. 3A) thus raising pump motor 62, pump 64 and cage 66 above surface 56 of the sludge pond. If it is desired to have vehicle 2 operate submerged, one need merely remove a cap 92 from each pontoon 22, 24 and add water sufficient to change the buoyancy of vehicle 2 so vehicle 2 sinks below instead of floats on surface 56 of sludge pond 4.

Modification and variation can be made to the disclosed embodiment without departing from the subject of the invention as defined in the following claims. For example, support arms 12, 14 are shown pivotally mounted to the remainder of the frame at a common pivot point 18. However, dual pivot points can be used as well. If desired, other means for changing the relative height or elevation of the pontoons and trash pump can be used. That is, trash pump 64, or just its suction inlet 94 (see FIGS. 5 and 6), can be made to be movable relative to frame 8 while pontoons 22, 24 remain at fixed elevations relative to the frame.

I claim:

1. A vehicle, used in conjunction with a separate waste processor, for removing flowable material from a containment region, the vehicle comprising:

a frame, including pivotally mounted support arms;

a suction pump, having a suction inlet for fluid contact with the material in the contained region, mounted to the frame;

means, coupled to the waste processor, for driving the pump;

means, coupled to the pump, for directing material from the containment region along a removal path from the suction pump to a discharge point point external of the vehicle;

first and second elongated pontoons, each including an axis, an external surface and ends, rotatably mounted to the support arms to the frame at their ends for rotation about their axes, the pontoons having spiral flights about their external surfaces;

means for selectively pivoting the support arms so that the relative pivotal movement of the arms changes the relative elevation between the suction inlet and the pontoons;

means for discharging a supplemental liquid into the containment region, the supplemental liquid discharge means including a manifold formed integrally with the frame and a nozzle supported by and fluidly coupled to the manifold for directing a stream of the supplemental liquid toward the suction inlet to aid removal of material from the containment region by the suction pump; and means for rotating the pontoons about their axes so the spiral flights drive the vehicle through the containment region.

2. The vehicle of claim 1 wherein the support arms at each end of each pontoon each include extension segments, and wherein the selective pivoting means includes a piston and cylinder combination coupling the extension segments at each end of the pontoons.

3. The vehicle of claim 1 wherein the support arms at each end are pivotally connected to one another at common pivot points.

4. The vehicle of claim 1 wherein the pump driving means includes a hydraulic motor mounted adjacent the pump.

5. The vehicle of claim 4 wherein the pump driving means includes an air pilot valve operably coupled to the pump for controlling the pump.

6. The vehicle of claim 1 wherein the supplemental liquid is high pressure hot water.

7. The vehicle of claim 1 further comprising means for injecting a stream of the supplemental liquid into the material passing along the removal path to aid movement of said material.

8. The vehicle of claim 1 further comprising an upwardly and outwardly extending boom, including a lower end and an upper end, the lower end pivotally mounted to the frame.

9. The vehicle of claim 1 further comprising a hollow boom pivotally mounted to the frame at one end, a portion of the removal path being along the interior of the hollow boom.

10. The vehicle of claim 1 further comprising a boom pivotally mounted to and extending upwardly and outwardly from the frame, and wherein the pump driving means includes a hydraulic motor for driving the suction pump, a hydraulic line passing from the waste processor, along the boom and to the suction pump, an air actuated pilot valve fluidly connected along the hydraulic line and an air control line passing from the waste processor and to the pilot valve to control the flow of hydraulic fluid to the hydraulic motor.

11. The vehicle of claim 1 wherein the spiral flights on the pontoons are wrapped in opposite rotary directions.

12. The vehicle of claim 1 wherein the pontoon rotating means are adapted so each pontoon can be independently rotated as to speed and rotary direction.

13. The vehicle of claim 1 further comprising means for changing the buoyancy of the vehicle.

* * * * *